US006651296B2

(12) United States Patent
Matsuda

(10) Patent No.: US 6,651,296 B2
(45) Date of Patent: Nov. 25, 2003

(54) KNIT-IN SLIDE FASTENER

(75) Inventor: Yoshio Matsuda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/155,784

(22) Filed: May 24, 2002

(65) Prior Publication Data

US 2002/0184741 A1 Dec. 12, 2002

(30) Foreign Application Priority Data

Jun. 7, 2001 (JP) ..... 2001-172911

(51) Int. Cl.[7] ..... A44B 19/56; D04B 7/16; D04B 21/14

(52) U.S. Cl. ..... 24/397; 24/392; 24/394; 24/396; 66/190; 66/193

(58) Field of Search ..... 24/392, 396, 397, 24/393, 398, 391, 394; 66/190, 192, 193

(56) References Cited

U.S. PATENT DOCUMENTS 4,002,045 A 1/1977 Fröhlich et al.
5,502,986 A * 4/1996 Matsuda et al. ..... 66/193
5,802,883 A * 9/1998 Matsuda et al. ..... 24/392
6,006,552 A * 12/1999 Matsuda et al. ..... 66/193
6,497,015 B1 * 12/2002 Kato et al. ..... 24/396

FOREIGN PATENT DOCUMENTS

| | | |
|---|---|---|
| EP | 0 059 351 A1 | 9/1982 |
| EP | 0 688 513 A2 | 12/1995 |
| EP | 0 925 736 A2 | 6/1999 |
| JP | 8-314 | 1/1996 |
| JP | 11-187909 | 7/1999 |

* cited by examiner

*Primary Examiner*—Victor Sakran
(74) *Attorney, Agent, or Firm*—Bell, Boyd & Lloyd LLC

(57) ABSTRACT

There is provided a knit-in slide fastener in which a continuous fastener element row is knitted simultaneously with the knitting of a warp knitted fastener tape at a fastener element mounting portion on a longitudinal side edge portion of the fastener tape. Since a yarn composed of ordinary long fibers, or a textured yarn is employed as a fixing knitting yarn for the fastener element mounting portion, even if a sewing needle is pierced into the textured yarn, the fixing knitting yarn is never cut off because the sewing needle passes through a number of fibers which compose the textured yarn. Further, even when part of the fibers are cut off, no fraying occurs in the yarns, so that the fastener element row at the cut off portions does not separate from the fastener tape.

5 Claims, 4 Drawing Sheets

KNIT-IN SLIDE FASTENER

BACKGROUND OF INVENTION

The present invention relates to a knit-in slide fastener in which a fastener tape thereof is composed of a warp knitting structure and a continuous fastener element row formed of thermoplastic-synthetic-resin-made monofilament is fixed along a fastener element mounting portion on a longitudinal side edge of the fastener tape simultaneously with knitting of the fastener tape. More particularly, it relates to a knit-in slide fastener which makes it possible to stabilize pitches between the fastener elements by forming a knitting structure of the fastener element mounting portion to be dense and to prevent any cutoff of composition yarns in the fastener element mounting portion due to a sewing needle when end portions of the fastener element rows are fixed.

For example, Japanese Patent Application Laid-Open No.8-314 has disclosed a knit-in slide fastener in which a continuous fastener element row is knitted in and fixed in the fastener element mounting portion formed along a longitudinal side edge of the tape at the same time when the fastener tape is knitted. In the knit-in slide fastener disclosed in the publication, another chain-stitch knitting yarn is knitted into a group of needle loops formed of chain-stitch knitting yarns in the fastener element row which composes a row of wale on the side of a fastener tape main portion such that it overlaps, so that the density of the knitting pattern of a foundation structure in the fastener element mounting portion is made large with the chain knitting formed in duplication, thereby stabilizing the mounting of the fastener element row.

Such technology for stabilizing the mounting of the fastener element row is also disclosed in for example, Japanese Patent Application Laid-Open No.11-187909. According to this publication, all yarns composing the fastener element mounting portion are provided with a higher heat shrinkage property than the yarns which compose the fastener tape main portion. Then after knitting, the composition yarns are subjected to heat treatment so as to allow the yarns in the fastener element mounting portion to shrink more than the composition yarns in the fastener tape main portion. Consequently, the fastener element mounting portion is formed to be dense so that its dimension can be stabilized, and the fastener element row is tightened firmly with the fixing chain-stitch knitting yarns in order to secure a high engagement strength.

In the fastener element mounting portion of the knit-in slide fastener disclosed in the above-described publication, any of the fixing knitting yarns for fixing the fastener element row onto the fastener tape is composed of ordinary long fiber yarns made of synthetic resin in order to secure a fixing strength.

The knit-in slide fastener disclosed in the publication restricts an operating end of a slider by providing both end portions thereof with an upper stopper and a lower stopper, in the same manner as an ordinary slide fastener. Because each of these upper and lower stoppers is usually composed of small pieces made of metallic material or synthetic resin material, their mounting portions of the stoppers are protruded outward when such a slide fastener is sewed to trousers or a skirt, so that its appearance is not good. Particularly, in the case of an upper stopper, which is mounted in a separate manner to the right and left, it is difficult to fit the slider to the same upper stopper, so that a fastener portion between the slider and the upper stopper is separated during use, thereby causing an inconvenience in appearance.

On the other hand, because the knit-in slide fastener, which the present invention aims at, is excellent in flexibility as compared to the woven fabric type slide fastener in terms of the structure, it has been often employed for particularly flexible clothes. However, if the slide fastener is attached with stoppers as mentioned above, the inconvenience becomes remarkable. For this reason, conventionally end portions of the fastener element rows of the fastener chain were sewed directly to an object such as clothes by a sewing needle, without attaching the stoppers.

When the fastener element row is being attached to clothes or the like by sewing the end portions thereof directly with a sewing needle, the sewing needle crosses over the end portions of the fastener element row for sewing. Then, the sewing needle may be pierced into the fixing knitting yarns existing at the fastener element mounting portion of the fastener tape located between the respective fastener elements or the other composition yarns existing at the mounting portion, so that the yarns pierced by the sewing needle can be cut down. Therefore, when the slide fastener is being opened or closed, or when mechanical operation is applied upon washing, the yarns of the fastener element mounting portion get frayed, or part of the fastener element row may be removed from the fastener tape.

If heat treatment such as thermal setting is carried out after the fastener stringer is manufactured, likewise the knit-in slide fastener which the present invention aims at, hardness and tension of the yarn itself are heightened. Therefore, the yarns tend to be cut off easily due to interference with the aforementioned sewing needle. Particularly, if a small-diameter yarn which is very flexible is used, the yarn is more likely to be cut off.

The present invention has been achieved to solve the above described problems, and a concrete object of the invention is to provide a knit-in slide fastener in which when end portions of a fastener element row are mounted directly to clothes by sewing, any of the yarns that compose the fastener element mounting portion of the fastener tape is never cut off due to an interference with a sewing needle, so that the yarns of the fastener element mounting portion are prevented from being frayed, thereby ensuring an excellent durability.

The above-described object can be achieved by a basic structure of the present invention, that is, a knit-in slide fastener comprising a continuous fastener element row, which is knitted therein simultaneously with knitting of a warp-knit fastener tape, at a fastener element mounting portion on a longitudinal side edge portion of the warp-knit fastener tape, said fastener element mounting portion being composed of a fixing knitting yarn for sandwiching and fixing upper and lower leg portions of each of the fastener elements from front and rear sides thereof and other knitting yarns, characterized in that said fixing knitting yarn is a textured yarn.

That is, according to the present invention, a textured yarn is employed for the fixing knitting yarn of the fastener element which is part of the composition yarns of the fastener element mounting portion. The textured yarn mentioned here refers to a processed yarn obtained by executing crimp processing for crimping fibers by means of deforming a number of long fibers obtained from spinning of synthetic resin material and thermally set them, and then applying air eddy to the crimped yarns so as to entangle the yarns with each other in a complicated style at every predetermined interval.

According to an experiment by the inventors of the present invention, it has been verified that the textured yarns can ensure as sufficient a fixing strength as the fixing knitting yarn composed of an ordinary long fiber yarn, so that it can be used for practical purpose from the viewpoints of the strength.

By the way, the fastener element mounting portion is formed continuously along the fastener tape main portion. The knitting structure thereof applies knitting yarns for connecting the fixing knitting yarns with stitches, or various kinds of in-laid yarns to be inserted through the stitches of the fixing knitting yarns, other than the fixing knitting yarns for the fastener element row. The typical knitting structure of the fixing knitting yarns include chain stitches, tricot stitches, two needle stitches and the like. These knitting structures are knitted independently or in combination. The various kinds of the in-laid yarns may include a warp in-laid yarn which is inserted while being entangled with sinker loops on a wale, a weft in-laid yarn which is inserted in between the sinker loops and needle loops over a multiplicity of wales.

Generally, if the chain knitting pattern is adopted as the fixing knitting yarn, two knitting yarns of the needle loop stride over the upper leg portion of an element while a single knitting yarn of its sinker loop is disposed so as to intersect the lower leg portion, so that the upper and lower leg portions are sandwiched and fixed. Thus, its tightening force is extremely stronger than the other fixing knitting pattern structure. Further, because the stretching in the direction of the wale (longitudinal direction of the fastener tape) is less due to the structure of the knitting pattern. Therefore, in the case where it is intended to knit the fastener elements into the fastener tape by adopting the structure for the fixing knitting yarn, the fixing of the fastener element is stabilized, which is particularly preferable.

However, originally, not only this chain knitting structure is less stretched in the direction of the wale as described above, but also if this is adopted for the fastener element fixing structure, a larger tension is produced in the chain-stitch knitting yarn after having been knitted than in an ordinary knitting yarn, so that a strong tension is applied thereto. Under this condition, when an element portion at the end portion of the fastener element row of the fastener stringer is attached to clothes by sewing, the yarn which is most likely to interfere with a sewing needle and be cut off thereby among the composition yarns of the fastener element mounting portion is often the aforementioned fixing knitting yarn which is exposed on the surface of the fastener elements and is being tightly stretched.

According to the present invention, the textured yarn having the above described structure as this fixing knitting yarn is used. Thus, when an end portion of the fastener element row of the fastener stringer with no end stop is attached to clothes by sewing, even if the sewing needle interferes with the strongly stretched fastener element fixing knitting yarn so that a tip of the sewing needle is pierced into that knitting yarn, a number of crimped fibers which compose each fixing knitting yarn are warped laterally and stretched only locally. As a result, the sewing needle can pass through between a number of the fibers, so that it never cuts off an entire part of the yarn. Further, even if the sewing needle is pierced into one of the composition fibers of the fixing knitting yarn and then cut off the fiber, no fraying occurs in the fibers because the cut off fiber is entangled with the other composition fibers in a complicated style at every predetermined interval.

According to the present invention, it is preferable that the fixing knitting yarn includes a chain-stitch knitting yarn and this fixing chain-stitch knitting yarn is a textured yarn, as mentioned above. Further, as already described, since a chain-stitch knitting yarn, which is most excellent in fixing strength, is employed as the fixing knitting yarn, the fixing strength to the fastener elements is also secured by the knitting structure.

Furthermore, it is preferable that a dry heat shrinkage ratio of the textured yarn is in a range of 6 to 10%. Further preferably, of composition yarns of the fastener element mounting portion, the dry heat shrinkage ratio of the knitting yarns other than the fixing knitting yarn is in a range of 12 to 15%. Still further, the dry heat shrinkage ratio of the composition yarns of the fastener tape main portion other than the fastener element mounting portion in the fastener tape is in a range of 6 to 8%.

Generally, in this kind of the slide fastener, as disclosed in Japanese Patent Application Laid-Open No. 11-187909, it is preferable to provide all the yarns which compose the fastener element mounting portion with the same dry heat shrinkage ratio because a strong tension is increased in the fixing knitting yarn coupled with the foundation structure, which strides over the upper leg portion of the fastener element, by heat treatment after having been knitted. On the other hand, in order to secure a dimensional stability of the fastener stringer and a predetermined mounting strength of the fastener element, it is preferable to set the dry heat shrinkage of all the composition yarns in the fastener element mounting portion to be higher than the dry heat shrinkage ratio of the composition yarns in the fastener tape main portion of the fastener tape.

However, in the conventional knit-in slide fasteners, the dry heat shrinkage ratio of the fixing knitting yarn is set lower than the dry heat shrinkage ratio of the other composition yarns in the fastener element mounting portion.

The reason is that the strength of each fiber is lower and likely to be cut off because the aforementioned fixing knitting yarn is a bundle of a number of fine fibers so that no unreasonable tension force is to be given. Further, the fixing knitting yarn having such a low shrinkage ratio can secure a total strength required for the fixing knitting yarn because the strength can be increased when each composition fiber is stretched.

Further, a dimensional stability of the fastener stringer and a fixing strength necessary for the fastener element row can be obtained by setting the dry heat shrinkage ratio of the composition yarns other than the fixing knitting yarn in the fastener element mounting portion to be high and by setting the dry heat shrinkage ratio of the fastener tape main portion of the fastener tape to be substantially as low as the fixing knitting yarn.

EMBODIMENT OF INVENTION

Hereinafter, an embodiment of the present invention will be described in detail with reference to examples shown in the accompanying drawings.

Figure 1:
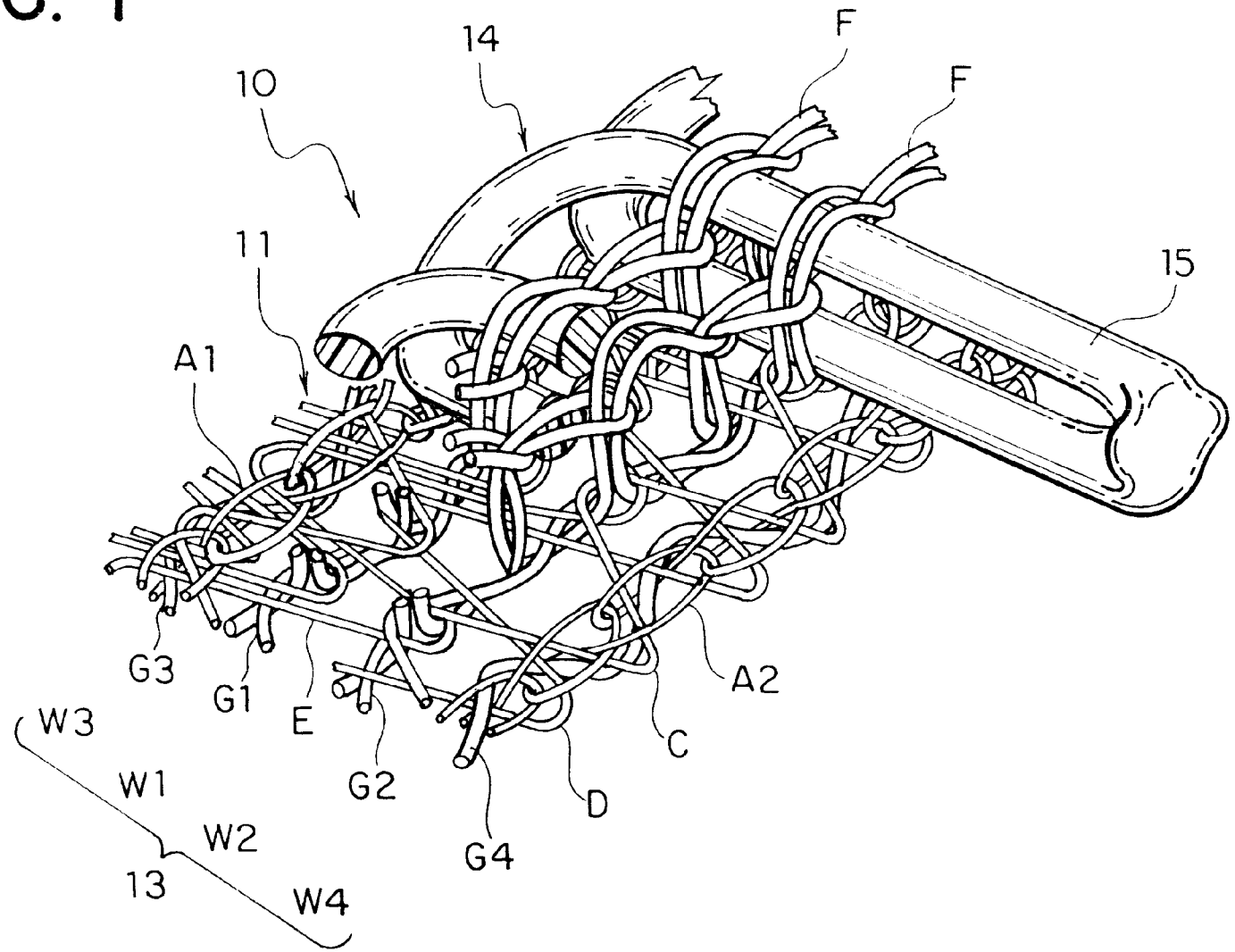
FIG. 1 is a perspective view of a fastener element mounting portion of a knit-in slide fastener as seen from a front side thereof, showing an embodiment of the present invention schematically.

In the meantime, FIG. 1 shows that the respective knitting yarns are loosened around the fastener element mounting portion while the fastener tape main portion is omitted for facilitating understanding of the drawing. However, it shall be understood that the knitting pattern and the entangling portions of each knitting yarn are tightened firmly in its actual state. Although the same figure shows diversified sizes of the knitting yarns, this only aims to facilitate understanding. Actually, the size of each knitting yarn may be selected arbitrarily considering the function of the knit-in slide fastener and the formation of the knitting pattern.

Further, the present invention should not be restricted to the knitting structure illustrated in the embodiment. For example, the present invention can be applied to not only the case where various kinds of knitting structures are applied as shown in FIGS. 6 to 11 of Japanese Patent Application Laid-Open No. 11-187909, but also the case of a double knitting structure as well as a single knitting structure. In addition to the knitting structure, the continuous fastener element row made of synthetic resin monofilament for use should not be restricted to a coil shape as illustrated in the example shown in the figures, but may be folded in a zigzag shape. A fastener stringer 10 according to this embodiment is composed of a single-knitting structure formed by a general warp-knitting machine having a single row of needle beds, as understood from these figures.

Foundation structure of a fastener tape main portion 12 according to this embodiment is composed of knitting yarns each formed of polyester-based synthetic fibers. Chain-stitch knitting yarn (A) as shown in FIGS. 3 and 4 composes a chain knitting structure of 0-1/1-0, tricot knitting yarn (B) composes a tricot knitting structure of 1-0/1-2, and each of three kinds of weft in-laid yarns (C), (D) and (E), which composes the same knitting structures of 0-0/2-2, 3-3/0-0 or 4-4/0-0, is inserted in a zigzag shape in a width direction of the fastener tape 11.

Figure 3:
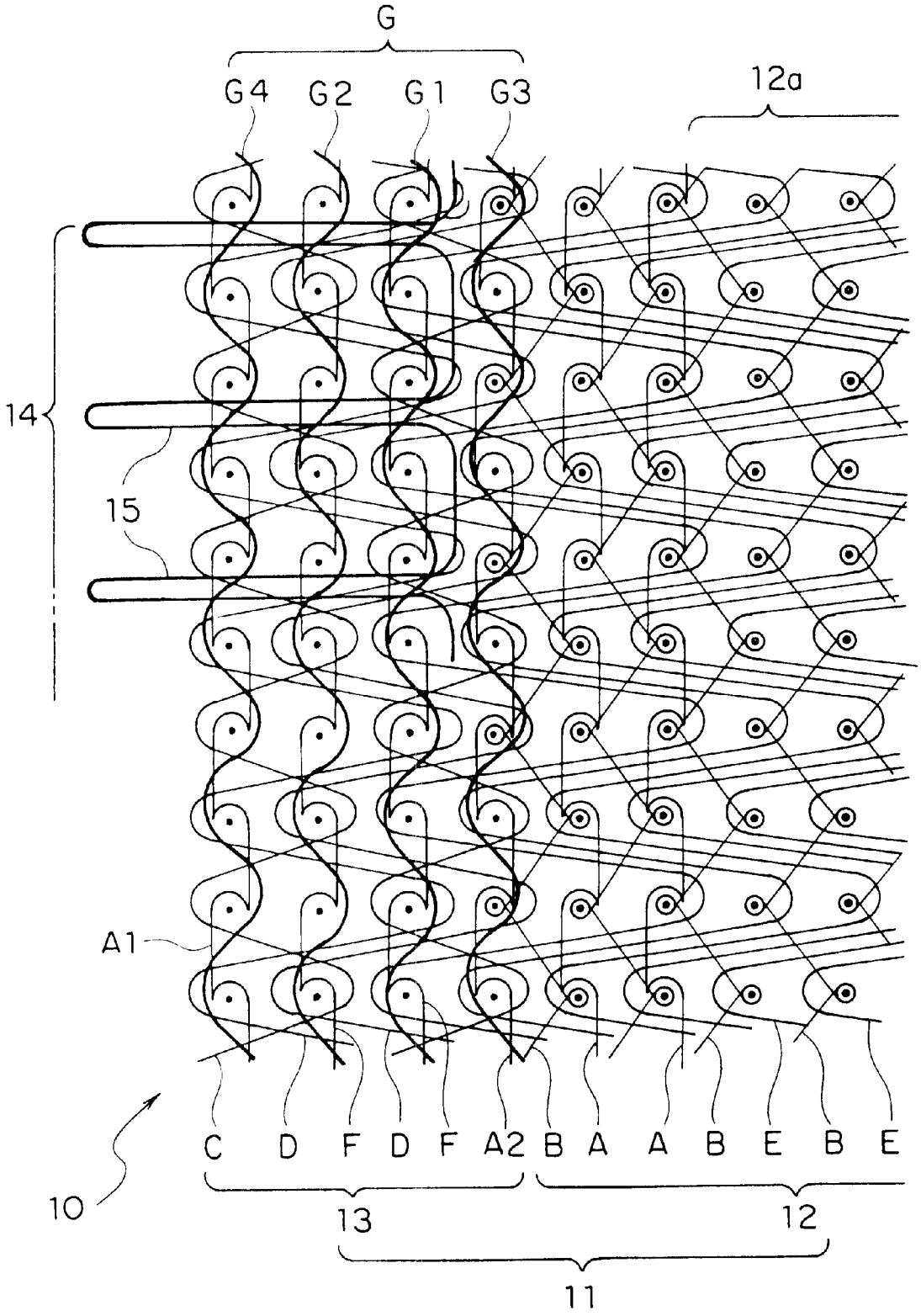
FIG. 3 is a partial pattern structure of the knit-in slide fastener.
Figure 4:
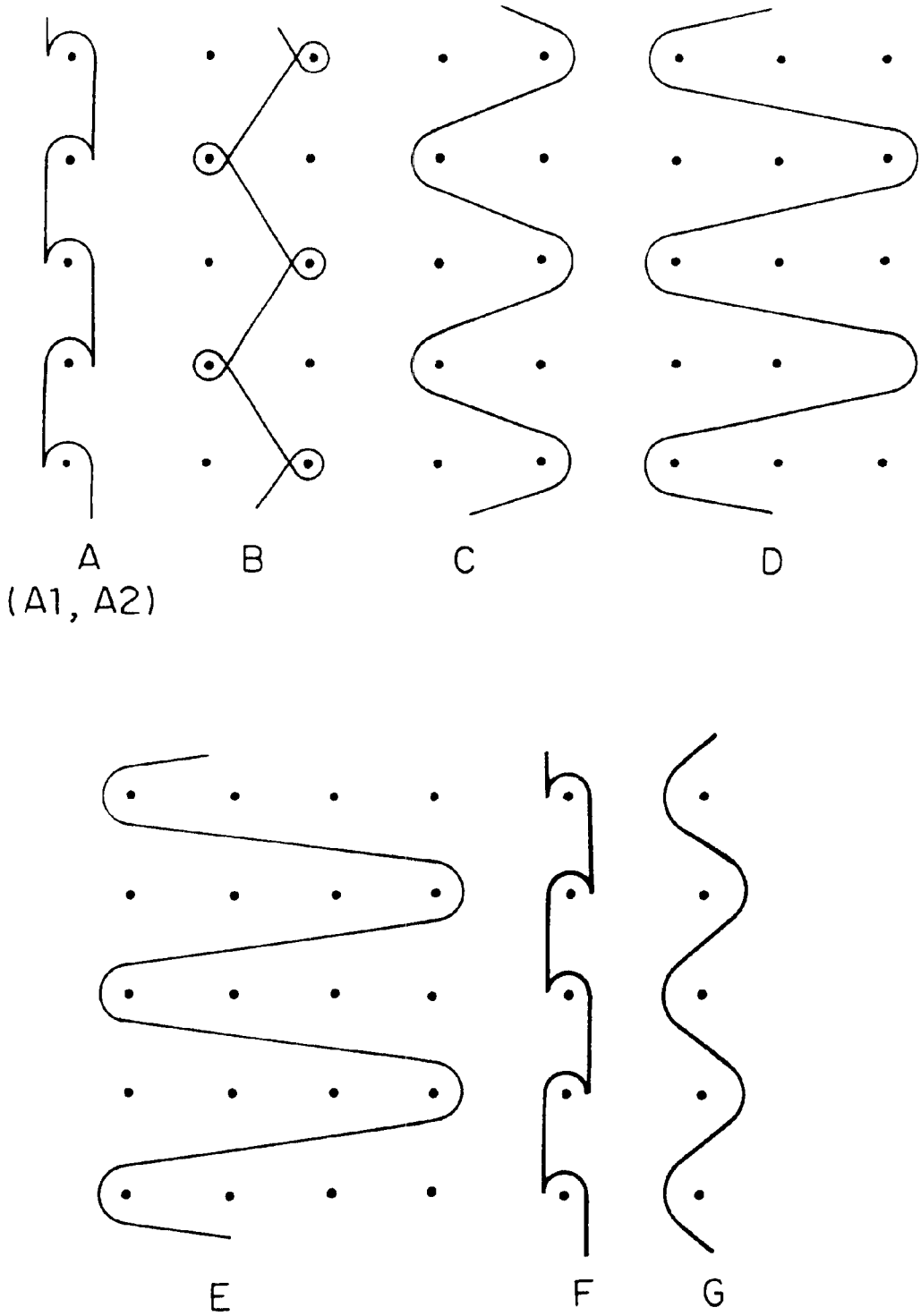
FIG. 4 is a pattern structure of each knitting yarn of the knit-in slide fastener.

According to this embodiment, the aforementioned chain-stitch knitting yarn (A) is omitted in the knitting structure located at an intermediate position 12*a* of the fastener tape main portion 12 as shown in FIG. 3 so as to provide the intermediate portion 12*a* with flexibility to fit well to a mounting object such as clothes, thereby facilitating a reliable installation of the slide fastener. Of course, the intermediate portion 12*a* of the fastener tape main portion 12 may be formed with the chain-stitch knitting yarn (A) like other portions without omitting the chain-stitch knitting yarn (A) or it is permissible to use the chain-stitch knitting yarn (A) with knitting yarns of any other knitting structure. The component yarn of the foundation structure of the fastener tape main portion 12 may be made of synthetic fiber material such as polyamide base, polypropylene as well as polyester base synthetic fiber material or a combination thereof.

According to this embodiment, four wales of the fastener tape 11 on a longitudinal side edge thereof serve as a fastener element mounting portion 13. In the mounting portion 13, a coil-shaped monofilament made of nylon 6 or nylon 66 is reciprocated in the width direction of the fastener tape 11 within the same course at every other course, so that the monofilament is knitted into the mounting portion 13, so that a fastener element row 14 can be formed. This fastener element row 14 is continuously attached and fixed by being knitted into the fastener element mounting portion 13 at every other course with fixing chain-stitch knitting yarns (F) of two wales, which are knitted in the same chain knitting structures 0-1/1-0 in the fastener element mounting portion 13, at the same time when the coil-like fastener element row 14 is formed.

Figure 2:
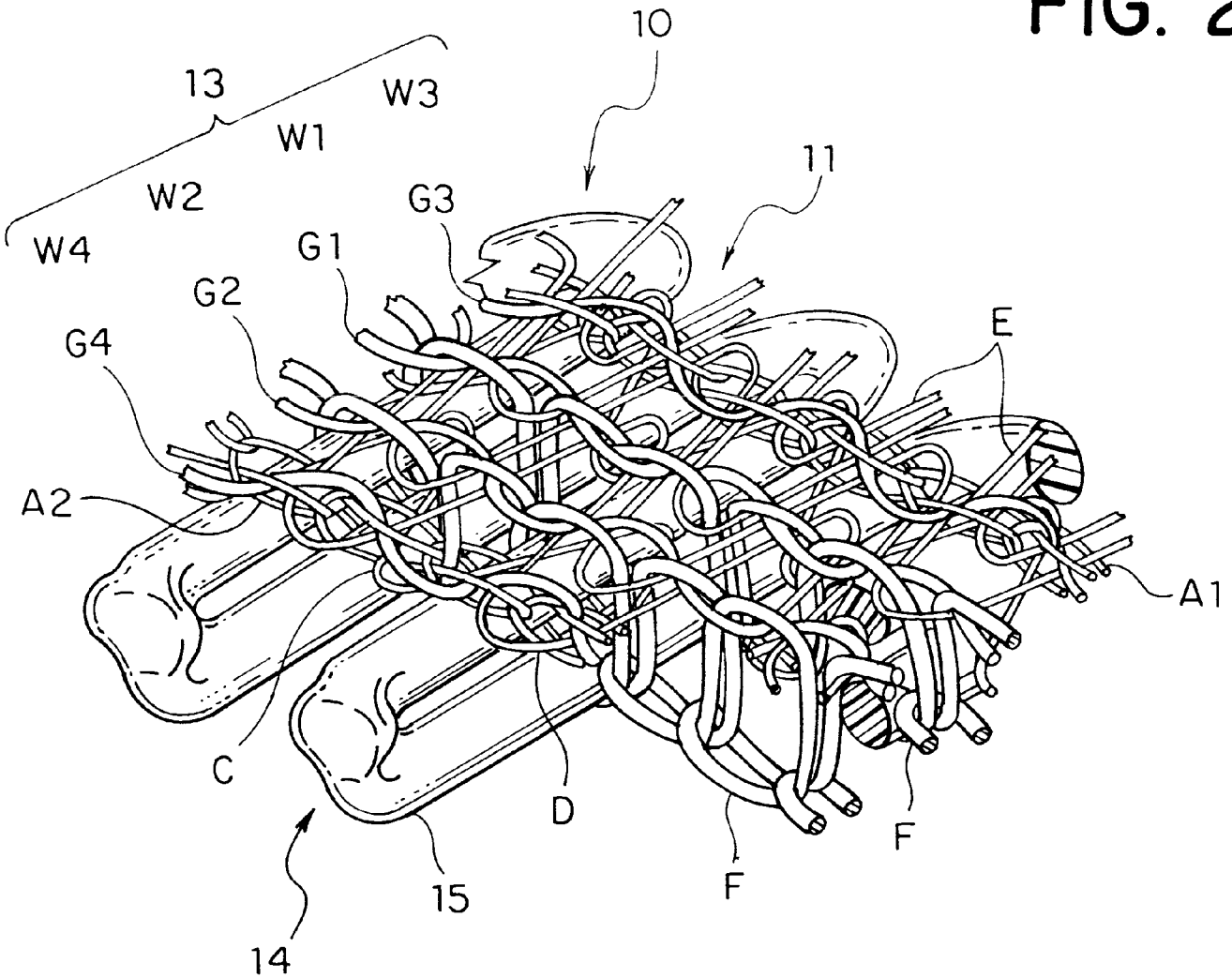
FIG. 2 is a perspective view as seen from a rear side thereof.

Meanwhile, as shown in FIGS. 1 and 2, this fixing chain-stitch knitting yarn (F) in this case is knitted in the longitudinal direction in such a manner that its needle loop strides over a top portion of a leg portion of each fastener element 15 of the fastener element row 14, so that the fastener element row is pressed down from its top toward the foundation structure by each needle loop group continuous in the wale direction so as to be fixed to the fastener element mounting portion 13. At this time, a sinker loop is located below each leg portion of the fastener element row 14 so as to form each sinker loop group continuous in the wale direction, thereby forming part of the foundation structure of the fastener element mounting portion 13 where the fastener element row 14 is placed.

According to this embodiment, warp in-laid yarn G1 is entangled with and inserted into successively every sinker loop of the respective sinker loop group of the fixing chain-stitch knitting yarns (F) in the knitting structure of 1-1/0-0, and knitted into the foundation structure of the fastener element mounting portion 13. In the meantime, according to the first embodiment, especially as shown in FIGS. 2 and 3, not only the respective warp in-laid yarns (G1, G2) are inserted along the fixing chain-stitch knitting yarns (F) of the two wales W1, W2 but also the warp in-laid yarns (G3, G4)are inserted along the chain-stitch knitting yarns (A1, A2), which are component yarns of the respective wales W3, W4 on opposite sides thereof, in a zigzag shape.

Consequently, the entire foundation structure of the fastener element mounting portion 13 is provided with a certain touch of feeling and configuration like a woven fabric, and can be stabilized dimensionally in the longitudinal transverse directions so that the fastener element row 14 can be fixed more stably.

In the meantime, these warp in-laid yarns (G1 to G4) may be inserted into only the fixing chain-stitch knitting yarns (F) of the fastener element row 14. Alternatively, it may be inserted into the chain-stitch knitting yarns composing the three wales including the outermost wale of the fastener tape 11 opposite to the fastener element mounting portion. Therefore, the illustrated example shows only one example of this invention. It shall be understood easily that this embodiment may include various modifications.

In the above described knitting structure of the present invention, it is important to use textured yarns for the fixing knitting yarns which are part of the composition yarns forming the aforementioned fastener element mounting portion 13, that is, the fixing chain-stitch knitting yarns (F) in the illustrated example. The textured yarn is formed to be a single yarn by deforming a plurality of long fibers to be thermally set, carrying out crimp processing for crimping the fibers and then, applying air eddy to them at every predetermined interval to be entangled with each other in a complicated style.

Further, according to this embodiment, the dry heat shrinkage ratio of the aforementioned fixing chain-stitch knitting yarn (F) is set to be lower than that of any of the warp in-laid yarn (G1 to G4) and the weft in-laid yarn (C), (D), which are the other composition yarns of the fastener element mounting portion 13, and the chain-stitch knitting yarn (A1, A2) of the fastener tape main portion 12 adjacent the fastener element mounting portion 13 and the chain-stitch knitting yarns (A1, A2) disposed at the outmost of the fastener element mounting portion 13. Further, the dry heat shrinkage ratio of the fixing chain-stitch knitting yarn (F) is set to be substantially equal to the heat shrinkage ratio of each of the chain yarn (A), the tricot yarn (B) and the weft in-laid yarn (E), which are the composition yarns of the intermediate position 12*a* of the fastener tape main portion 12.

Now, this will be explained more concretely with reference to numerical values. The dry heat shrinkage ratio of the warp in-laid yarns (G1 to G4), which are 100 to 150 deniers, among the composition yarns of the fastener element mounting portion 13 is in a range of 15 to 40%, preferably 20 to 30%. The dry heat shrinkage ratio of the fixing chain-stitch knitting yarn (F), which is composed of a textured yarn of 150 to 500 deniers in average size, is 6 to 10%, while the chain-stitch knitting yarn (A1, A2), the weft in-laid yarns (C) and (D), which are 200 to 350 deniers, have a dry heat shrinkage ratio of 12 to 15%. Further, the chain-stitch knitting yarn (A), the tricot knitting yarn (B) and the weft in-laid yarn (E), which are composition yarns of the fastener tape main portion 12, are 200 to 300 deniers and their dry heat shrinkage ratio is in a range of 6 to 10%, preferably 5 to 8%.

Here, the aforementioned shrinkage ratios are determined based on the material of fiber or filament, the extension magnification upon being stretched and the set temperature. Generally, a high shrinkage yarn is low with respect to the extension magnification and the set temperature, and its crystallization density is low. Therefore, its strength is low, while its stretching degree is high. On the other hand, an ordinary yarn, which is often used, has a high extension magnification and set at a high temperature in a stretched manner, so that its degree of crystallization is raised. Thus, its strength is increased while its shrinkage ratio is lowered.

According to this embodiment, setting the dry heat shrinkage ratio of the fixing knitting yarn (F) to be lower than the dry heat shrinkage ratio of each of the other composition yarns (A1, A2), (G1 to G4), (C) and (D) helps us to understand that the composition fiber is subjected to a high stretch processing. Thus, the total tensile strength of the fixing knitting yarn (F) becomes higher than that of each of the other composition yarns (A1, A2), (G1 to G4), (C) and (D). Therefore, the shrinkage amount of the fixing knitting yarn (F) in a thermal setting after having been knitted is lower than that of each of the other composition yarns (A1, A2), (G1 to G4), (C) and (D) and their tensile strengths are sufficiently endurable to practical use.

In the knit-in slide fastener of the present invention in which the synthetic resin fastener element row 15 is knitted at the same time when the fastener tape 11 is knitted, if the relations of the respective heat shrinkage ratios of the composition yarns (A1, A2), (F), (C), (D) and (G1 to G4) of the fastener element mounting portion 13 and the composition yarns (A), (B) and (E) of the fastener tape main portion 12 are set as described above and the knitting formation density is set to be an ordinary one, when heat treatment is carried out after the knitting formation, the composition yarns of the fastener element mounting portion 13 shrink more than the composition yarns of the fastener tape main portion 12. Therefore, the knitting density of the fastener element mounting portion 13 is raised so that the knitting pattern becomes dense. Consequently, not only a feeling of touch of a woven fabric based on the above-described knitting structure can be secured but also its configuration is stabilized.

Further, the fastener element row 14 is tightened firmly with the fixing chain-stitch knitting yarns (F). Therefore, even when the fastener stringer 10 is bent strongly in the direction of the tape face, separation of the elements never occurs, thereby securing a strong meshing strength.

Further, because the fastener stringer 10, which is an ordinary knit product, includes the fastener element row 14 knitted therein, the fastener element mounting portion 13 is knitted longer than that of the fastener tape main portion 12. Consequently, the entire shape of the fastener stringer 10 is curved in a form of arc such that the fastener element row 14 is protruded outward into the same plane. However, by the above-described heat shrinkage treatment, the shrinkage of the fastener element mounting portion 13 is larger than the fastener tape main portion 12. Therefore, the fastener stringer becomes almost straight or the fastener element row 14 is curved slightly inward in a concave shape.

The prominent point of the present invention is that the aforementioned fixing chain-stitch knitting yarn (F) is composed of a textured yarn having the above described structure. Consequently, when the fastener stringer without upper and lower end stops as a final product is attached to an opening portion of trousers, a skirt or the like and the fastener elements at both ends of the fastener element row 14 are fixed to the end portions of the opening by sewing, even if a sewing needle is pierced into the fixing chain-stitch knitting yarns (F) of the fastener element row 14, a number of crimped fibers which compose the fixing chain-stitch knitting yarns are warped laterally so that they are stretched locally. Thus, the sewing needle can pass through those fibers, so that the fixing chain-stitch knitting yarn (F) is prevented from being cut off.

For that reason, no fraying, which is generated if the fixing knitting yarn is cut off, occurs in the yarns, so that fixing strength to the fastener element 15 can be maintained. As a result, even if the slide fastener is opened/closed or any mechanical operating force by washing or the like is applied, the yarn fraying never induces separation of the fastener element rows 14 from the fastener tape 11.

As being evident from the above description, the present invention should not be restricted to the above described embodiment. For example, the knitting structure of the fastener tape is not restricted to the above described embodiment but may employ diversified structures. Further as already described, the size of each knitting yarn which composes the foundation structure of the above embodiment may be selected arbitrarily. Particularly, in the above embodiment, the size of the warp in-laid yarn (G4), which is to be inserted into the chain-stitch knitting yarn (A2) disposed nearest to the coupling heads of the fastener elements, may be sometimes larger than that of the warp in-laid yarns (G1, G2) which is to be inserted into the fixing chain-stitch knitting yarn (F) disposed inside thereof. In this case, an edge portion of the fastener element mounting portion is formed thick, so that it is sufficiently resistant to an upward folding or a pushing relative to the fastener surface, thereby making it possible to suppress separation of the fastener elements.

What is claimed:

1. A knit-in slide fastener in which a continuous fastener element row is knitted simultaneously with knitting of a warp-knit fastener tape, at a fastener element mounting portion on a longitudinal side edge portion of the warp-knit fastener tape, said fastener element mounting portion being composed of a fixing knitting yarn for sandwiching and fixing upper and lower leg portions of each of the fastener elements from front and rear sides thereof and other knitting yarns, wherein said fixing knitting yarn is a textured yarn.

2. A knit-in slide fastener according to claim 1, wherein said fixing knitting yarn includes a chain-stitch knitting yarn, and the fixing chain-stitch knitting yarn is a textured yarn.

3. A knit-in slide fastener according to claim 1, wherein a dry heat shrinkage ratio of said textured yarn is in a range of 6 to 10%.

4. A knit-in slide fastener according to claim 3, wherein, of composition yarns of said fastener element mounting portion, the dry heat shrinkage ratio of the knitting yarns other than said fixing knitting yarn is in a range of 12 to 15%.

5. A knit-in slide fastener according to claim 3, wherein the dry heat shrinkage ratio of composition yarns of a fastener tape main portion other than said fastener element mounting portion in said fastener tape is in a range of 6 to 10%.

* * * * *